United States Patent [19]

Cheng

[11] Patent Number: 4,678,152

[45] Date of Patent: Jul. 7, 1987

[54] APPARATUS FOR SUPPORTING OR ERECTING STRUCTURES

[75] Inventor: Eric K. Cheng, London, United Kingdom

[73] Assignee: Reyloc Limited, London, United Kingdom

[21] Appl. No.: 652,975

[22] Filed: Sep. 21, 1984

[30] Foreign Application Priority Data

Oct. 6, 1983 [GB] United Kingdom ..... 8326708
Jun. 28, 1984 [GB] United Kingdom ..... 8416500

[51] Int. Cl.[4] ..... E04F 19/06
[52] U.S. Cl. ..... 248/225.1; 248/224.4
[58] Field of Search ..... 248/225.1, 222.2, 221.3, 248/227, 220.2, 223.2, 223.3, 235, 317, 224.4; 52/36

[56] References Cited

U.S. PATENT DOCUMENTS

| | | | |
|---|---|---|---|
| 883,742 | 4/1908 | Rice | 248/222.2 |
| 1,055,050 | 3/1913 | Knape | 248/222.2 |
| 1,375,617 | 4/1921 | Tonguett | 248/222.2 |
| 1,938,370 | 12/1933 | Bodkin | 248/222.2 |
| 2,728,480 | 12/1955 | Close . | |
| 2,845,188 | 7/1958 | Rosenquist . | |
| 3,173,178 | 3/1965 | Kumburis | 248/225.1 |
| 3,367,286 | 2/1968 | Zantzen | 248/222.2 |
| 3,480,345 | 11/1969 | Torok . | |
| 3,628,762 | 12/1971 | Williams | 248/222.2 |
| 3,695,568 | 10/1972 | Hogrebe | 248/223 |
| 4,086,709 | 5/1978 | Jackson | 248/222.2 |
| 4,193,650 | 3/1980 | Gray | 312/205 |
| 4,344,593 | 8/1982 | Canto | 248/222.2 |
| 4,434,537 | 3/1984 | Bean | 248/221.3 |

FOREIGN PATENT DOCUMENTS

| | | |
|---|---|---|
| 510146 | 2/1955 | Canada . |
| 960184 | 12/1974 | Canada . |
| 1366000 | 6/1964 | France . |
| 283000 | 12/1952 | Switzerland . |
| 545200 | 5/1942 | United Kingdom . |
| 593443 | 10/1947 | United Kingdom . |
| 609046 | 9/1948 | United Kingdom . |
| 753081 | 7/1956 | United Kingdom . |
| 765986 | 1/1957 | United Kingdom . |
| 796854 | 6/1958 | United Kingdom . |
| 804281 | 11/1958 | United Kingdom . |
| 815686 | 7/1959 | United Kingdom . |
| 838780 | 6/1960 | United Kingdom . |
| 861148 | 2/1961 | United Kingdom . |
| 973688 | 10/1964 | United Kingdom . |
| 1020471 | 2/1966 | United Kingdom . |
| 1044817 | 10/1966 | United Kingdom . |
| 1064978 | 4/1967 | United Kingdom . |
| 1070391 | 6/1967 | United Kingdom . |
| 1158625 | 7/1969 | United Kingdom . |
| 1170906 | 11/1969 | United Kingdom . |
| 1241980 | 8/1971 | United Kingdom . |
| 1348416 | 3/1974 | United Kingdom . |
| 1350394 | 4/1974 | United Kingdom . |
| 1386409 | 3/1975 | United Kingdom . |
| 1460392 | 6/1977 | United Kingdom . |
| 2019479A | 10/1979 | United Kingdom . |
| 2095101A | 9/1982 | United Kingdom . |

*Primary Examiner*—Reinaldo P. Machado
*Assistant Examiner*—Alvin Chin-Shue
*Attorney, Agent, or Firm*—Morgan & Finnegan

[57] ABSTRACT

There is disclosed a bracket specially designed so that a panel fixed to the bracket can be easily and reliably engaged with the rail.

A die cast bracket for use in supporting a panel has a first slot in a vertical edge and a second slot in a horizontal edge, and has a web located in a substantially vertical plane in use, the web having means whereby the panel can be fixed thereto.

A kit for supporting a wall-supported item of furniture having vertical panels, the kit including at least one elongate support member, the elongate support member having a vertical web and a horizontal web, the horizontal web having a vertically downwardly extending flange and the vertical web having a horizontal extending flange, and the panel having or carrying a bracket or the like having one slot to receive the vertical flange and one slot to receive the horizontal flange when the panel is assembled to a horizontally-extending elongate support member.

Brackets as disclosed are durable and allow panels to be hung and removed, without deterioration.

6 Claims, 29 Drawing Figures

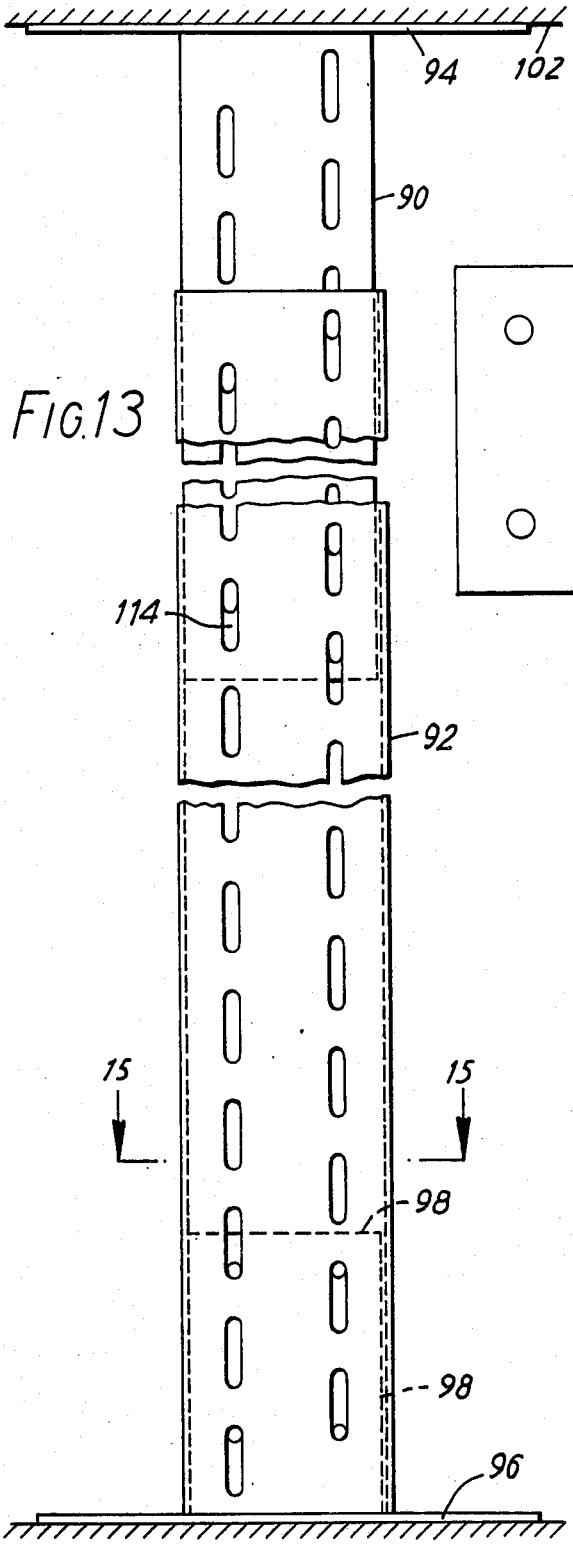
FIG.13
FIG.15
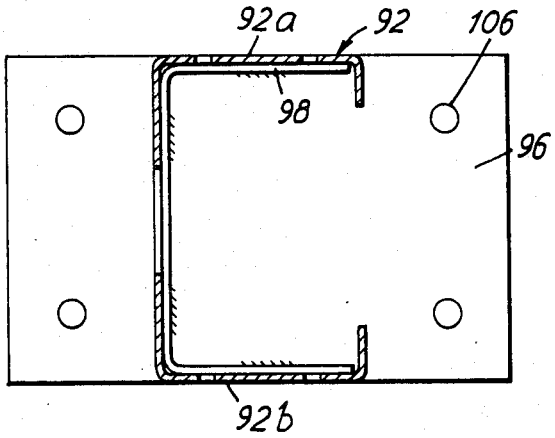
FIG.14
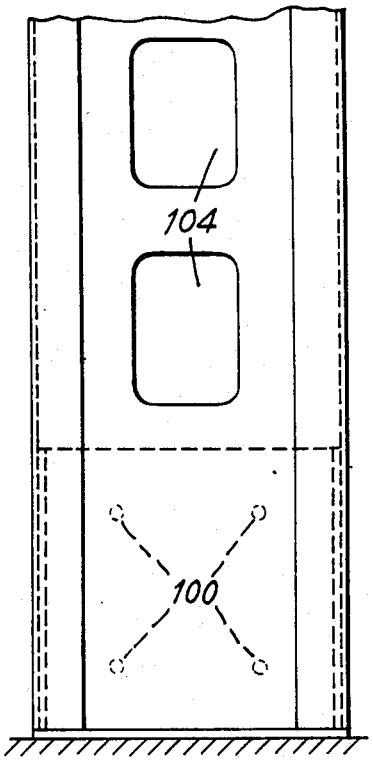

APPARATUS FOR SUPPORTING OR ERECTING STRUCTURES

RELATED APPLICATIONS

This application is related to co-pending U.S. patent application Ser. No. 620,476 filed on June 14, 1984, issued Dec. 2, 1986, U.S. Pat. No. 4,625,471.

FIELD OF THE INVENTION

This invention relates to apparatus for supporting or erecting structures, and in particular to brackets for connecting panels to substantially horizontal rails or other elongate support members.

In this specification the word structures is used to mean partitions and space divider panels, parts of portable buildings, shelving whether industrial or domestic, cupboards, bins, racks, shelves, desks, display units for use in retailing or at exhibitions or conferences. Such display units may be fitted or assembled units for dividing and using space.

BACKGROUND OF THE INVENTION

It has been proposed in U.K. patent application No. 83-26708 that panels forming parts of structures be suspended from a wall or ceiling using an elongate support member (herein also called a rail) extending horizontally and an interfitting arrangement between the rail and the panel so that the panel is supported by the rail, the latter being fixed to the wall or ceiling.

The reader is referred to the said application No. 83-26708 whose contents are hereby incorporated in this Specification.

BRIEF SUMMARY OF THE INVENTION

According to one aspect of the present invention, there is provided a bracket specially designed so that a panel fixed to the bracket can be easily and reliably engaged with the rail.

According to another aspect of the invention, a die cast bracket for use in supporting a panel has a first slot in a vertical edge and a second slot in a horizontal edge, and has a web located in a substantially vertical plane in use, the web having means whereby the panel can be fixed thereto.

PARTICULAR EMBODIMENTS

According to an embodiment of the invention, a bracket according to the invention has slots or steps, one slot or step being in an upper surface of the bracket and one slot or step being in a surface which is to be forwardly-presented in use, the bracket also having means such as a web or a pair of flanges whereby a panel can be secured thereto.

In the case of a bracket having a pair of slots, which is presently-preferred arrangement, each slot preferably has a lesser width at its base than it does at its mouth.

A bracket according to one embodiment of the invention has a pair of substantially parellel, planar, similarly-shaped walls joined by a bridge piece, each such wall having a first notch or step in a vertical edge and a step or termination or a second notch in a substantially horizontal edge. There are preferably aligned holes in the walls for receiving screws, pins, bolts, rivets or the like whereby a corner of a panel can be placed between the walls and secured to the bracket.

The bracket mentioned in the preceeding paragraph may be made of sheet metal although of course it may be made of other materials which have sufficient strength and rigidity. In a preferred form of bracket, the bridge piece is planar and located in a plane about 30° to 60° to the vertical, preferably 45° when the bracket is located in its usual position of use. In an alternative form of bracket, the bridge piece is substantially horizontal and extends between and joins parts of the lower edges of the walls.

In this specification, in the interest of clarity of description and to aid brevity, the words horizontal, vertical, upper and lower are used in relation to brackets in their normal position of use in suspending or supporting panels and like members; these words are not intended to have a strict geometrical meaning since a man of average skill in this art will appreciate that minor deviations from strictly vertical or strictly horizontal can be tolerated in some instances without affecting the satisfactory operation of the invention in assembling structures.

In another alternative version of the invention, the bridge piece on the bracket is vertical, and is provided with holes whereby a rear panel defining a space, e.g. the rear panel of a cupboard or the like, can be located parallel and adjacent to, and be bolted to, the bridge piece.

An important advantage of brackets according to the invention, when used with the rails generally described herein, is that they are durable and facilitate the ready attachment of panels to the rails; the panels may be located as desired with their planes either perpendicular or parallel to the length of the rail and my be attached and removed frequently, if desired, without deterioration of the panel.

According to another aspect of the invention, there is provided a kit for supporting a wall-supported item of furniture having vertical panels, the kit including at least one the elongate support member, the elongate support member having a vertical web and a horizontal web, the horizontal web having a vertically downwardly extending flange and the vertical web having a horizontal extending flange, and the panel having or carrying a bracket or the like having one slot to receive the vertical flange and one slot to receive the horizontal flange when the panel is assembled to a horizontally-extending elongate support member.

The invention may be employed in apparatus consisting of or including a structure having at least two vertical panels serving as side walls and at least one vertical rear wall panel, the structure being suspended from a horizontal elongate support member which is itself supported by a pair of vertical stanchions.

BRIEF DESCRIPTION OF THE DRAWINGS

The invention will be better understood from the following non-limiting description of examples thereof given with reference to the accompanying drawings in which:

FIGS. 13–16 are respectively a side elevation, a front elevation, a cross section in a horizontal plan, and a perspective view of a telescopic vertical stanchion and rails which may be used in a system according to the invention, FIG. 16 showing the stanchion connected to rails which can be used with the brackets of the general kind shown in FIGS. 5–7;

DETAILED DESCRIPTION OF EMBODIMENTS

Figure 1:
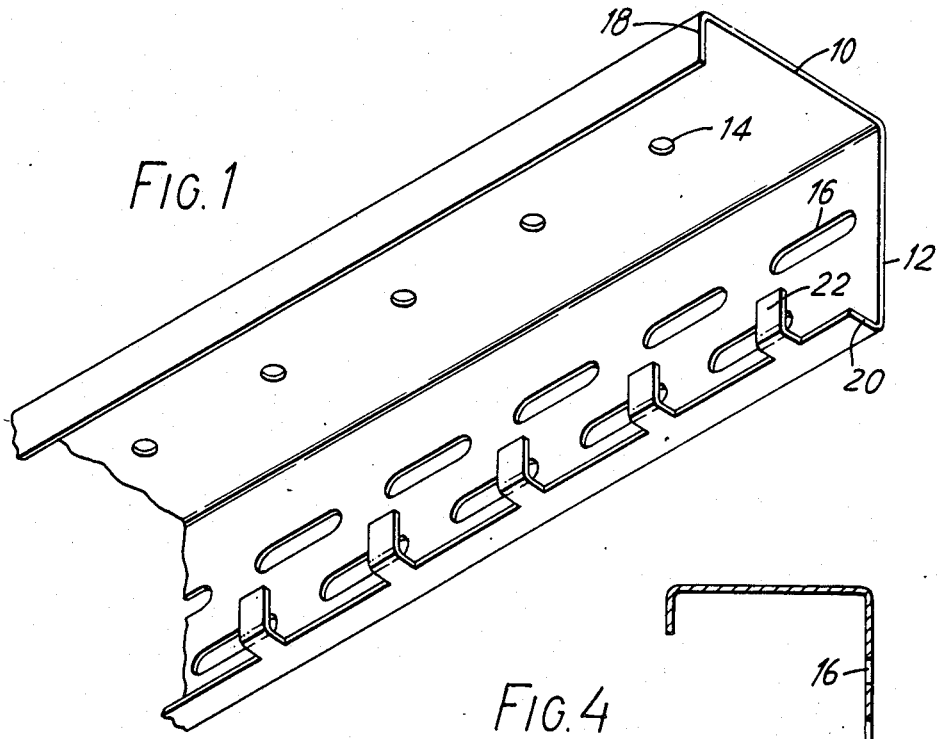
FIGS. 1–4 are respectively perspective, front elevation, underplan, and cross-sectional views of a first embodiment of an elongate support member (herein also referred to as a rail) useful with the present invention, the support member being such that it can be attached to a wall or a ceiling or other support surface to extend horizontally.
Figure 4:
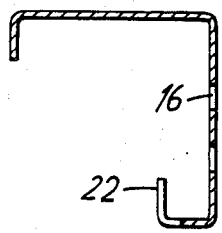
Figure 2:
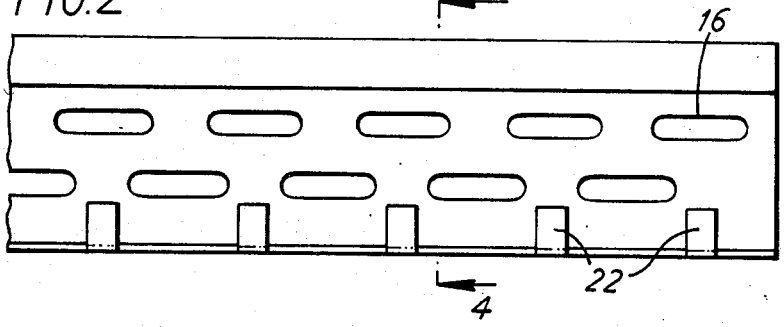
Figure 3:
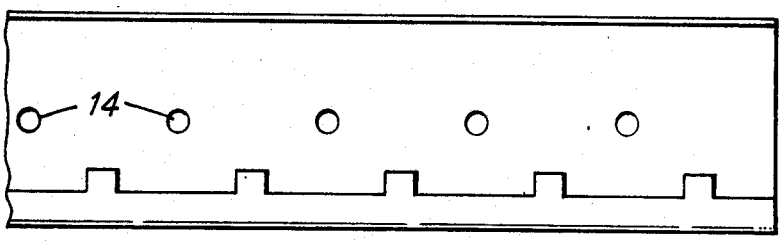

Brackets according to the invention utilize the principles outlined in the aforesaid Patent Application No. 83-26708 in that the "lift and rotate" method of assembly to a rail is employed. For a full description, the reader is referred to the said application, which is to be regarded as incorporated in its entirety in the disclosure of the present application. Put briefly, the rail has a vertical web and a horizontal web and the vertical web has a horizontally extending flange. The horizontal web has a vertically extending flange and the rail is constructed to co-operate with a bracket secured to a panel. An engaging means (e.g. a notch, step, or slot) is provided between the upper edge of the panel and the rail and arranged to preclude horizontal separation of the panel and the rail once they are assembled together in the manner hereinafter stated. The bracket has a notch or slot in its inner edge, the notch being positioned and dimensioned to receive the horizontally extending flange when the bracket is engaged with the rail. This supports the panel against vertical movement.

In accordance with a preferred embodiment of the present invention, the bracket has therein a notch dimensioned and positioned to be entered by a vertically and downwardly extending flange of a rail; this serves to prevent horizontal separation of the bracket and panel from the rail once they are assembled as described hereafter. The notch in the upper bracket edge is preferably of decreasing width and is defined by a vertical surface and a curved or inclined surface, the latter surface being located further from the rail (when the rail and bracket are assembled) than the former. The bracket is located on what will be the top inner corner of the panel when it is suspended from the rail; for brevity of description this corner is herein referred to as the support corner. This construction allows a panel to be hung by a simple procedure in which the panel is presented manually to the rail substantially in a vertical plane perpendicular to the length of the rail, with its support corner slightly lower than its other top corner. The top surface notch in the bracket is then brought adjacent the downwardly extending flange and the panel is lifted so that this flange partly enters the notch. Simultaneously, the panel (still substantially vertical) is rotated slightly about an axis perpendicular to its plane, so that the horizontally extending flange at the lower part of the rail enters the notch in the inner edge of the bracket. This rotation movement of the panel is continued until the panel inner edge is vertical and both flanges are fully seated in their respective notches. In this position the bracket and hence the panel is stably and firmly supported by the rail. Shelves can then if desired be supported by an adjacent pair of panels which are themselves supported by a single horizontal rail.

Only one rail need be fixed to the wall or ceiling so erection and assembly of shelves, cupboards or cabinets is particularly simple.

Figure 5:
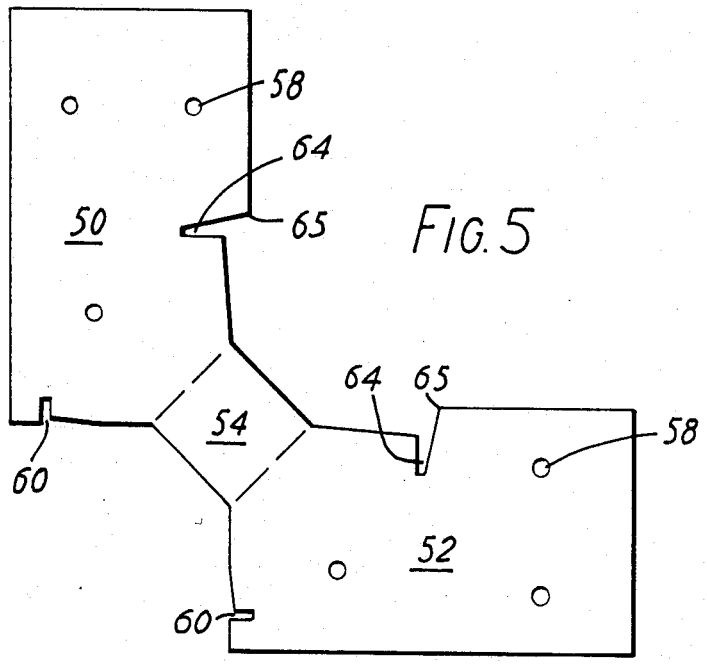
FIG. 5 is a profile of a blank for making one form of bracket according to the invention.
Figure 6:
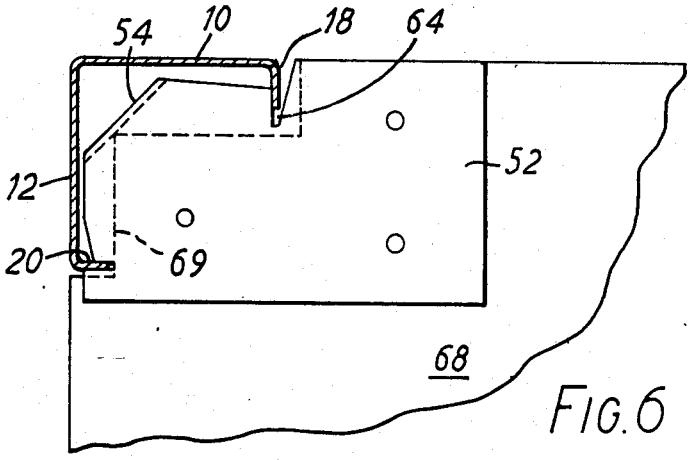
FIG. 6 is a side view of a bracket made from the blank of FIG. 5 shown in co-operation with a panel and an elongate support member.
Figure 7:
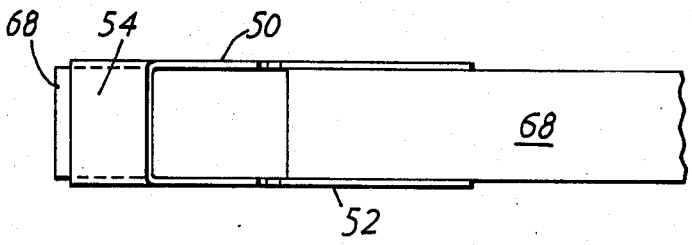
FIG. 7 is a plan view of the bracket and part of a panel shown in FIG. 6.
Figure 8:
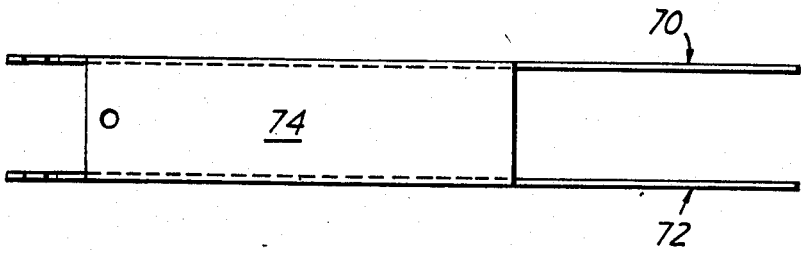
FIGS. 8–11 are respectively plan, side elevation, end elevation, and plan of a blank of another form of bracket according to the invention.
Figure 9:
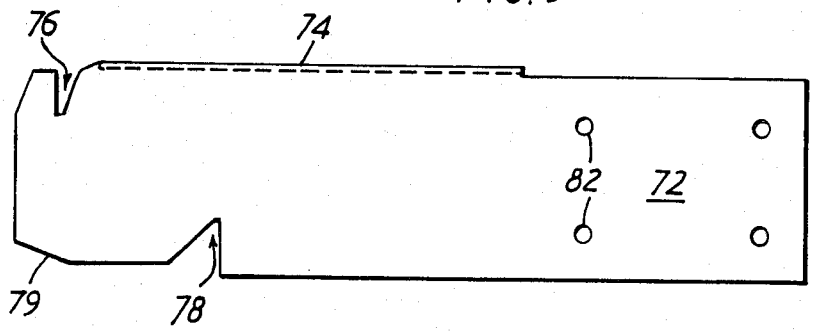
Figure 10:
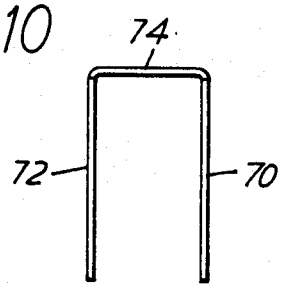
Figure 11:
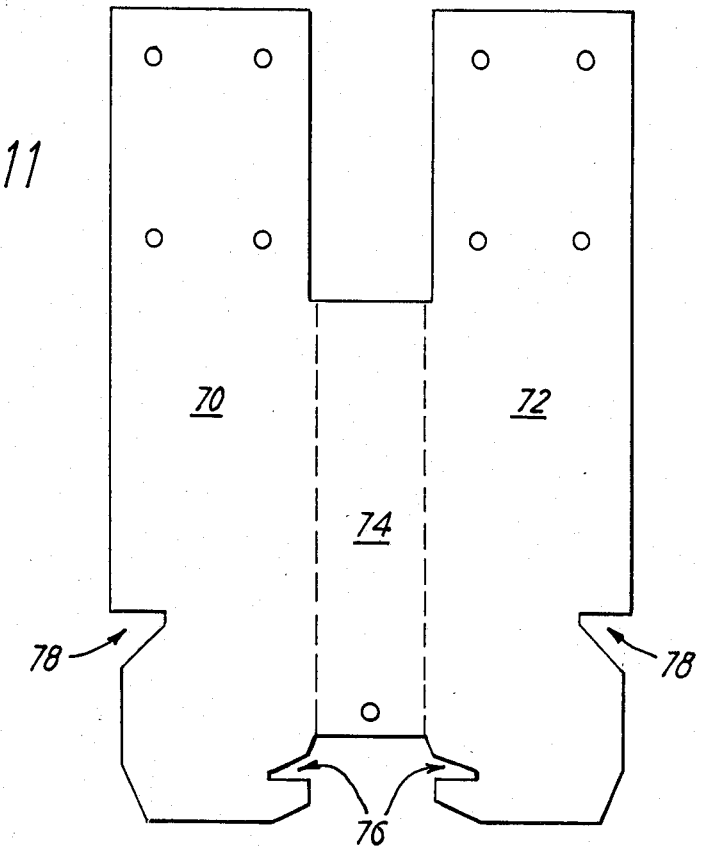

Referring now to FIGS. 1–4 the illustrated rail is a linear elongate support member having a horizontal web 10 and a vertical web 12. These webs may have holes 14 or slots 16 as appropriate to enable the rail to be fixed in position as desired. A vertical flange 18 extends downwardly from the horizontal web and a horizontal flange 20 having castellations at regular intervals extends from the lower region of the vertical web 12. The castellations illustrated have upturned tabs 22. The rail of FIGS. 1–4 is intended to receive a bracket such as is shown in FIGS. 5–7. The rail is mounted horizontally by being bolted or screwed to a wall, with the web 12 engaging the wall and the flange 20 downwardly and the web 10 upwardly. A modification of the rail of FIGS. 1–4 mounted with flange 20 uppermost and web 10 extending horizontally from the web 12 at its lower end is appropriate for receiving a bracket in accordance with FIGS. 8–10 herein, as can be seen from an inspection of FIG. 12. The modification is that the flange 20 is continuous rather than recessed and that there is a continuous flange instead of the spaced lugs 22 at right angles to the flange 20.

Figure 16:
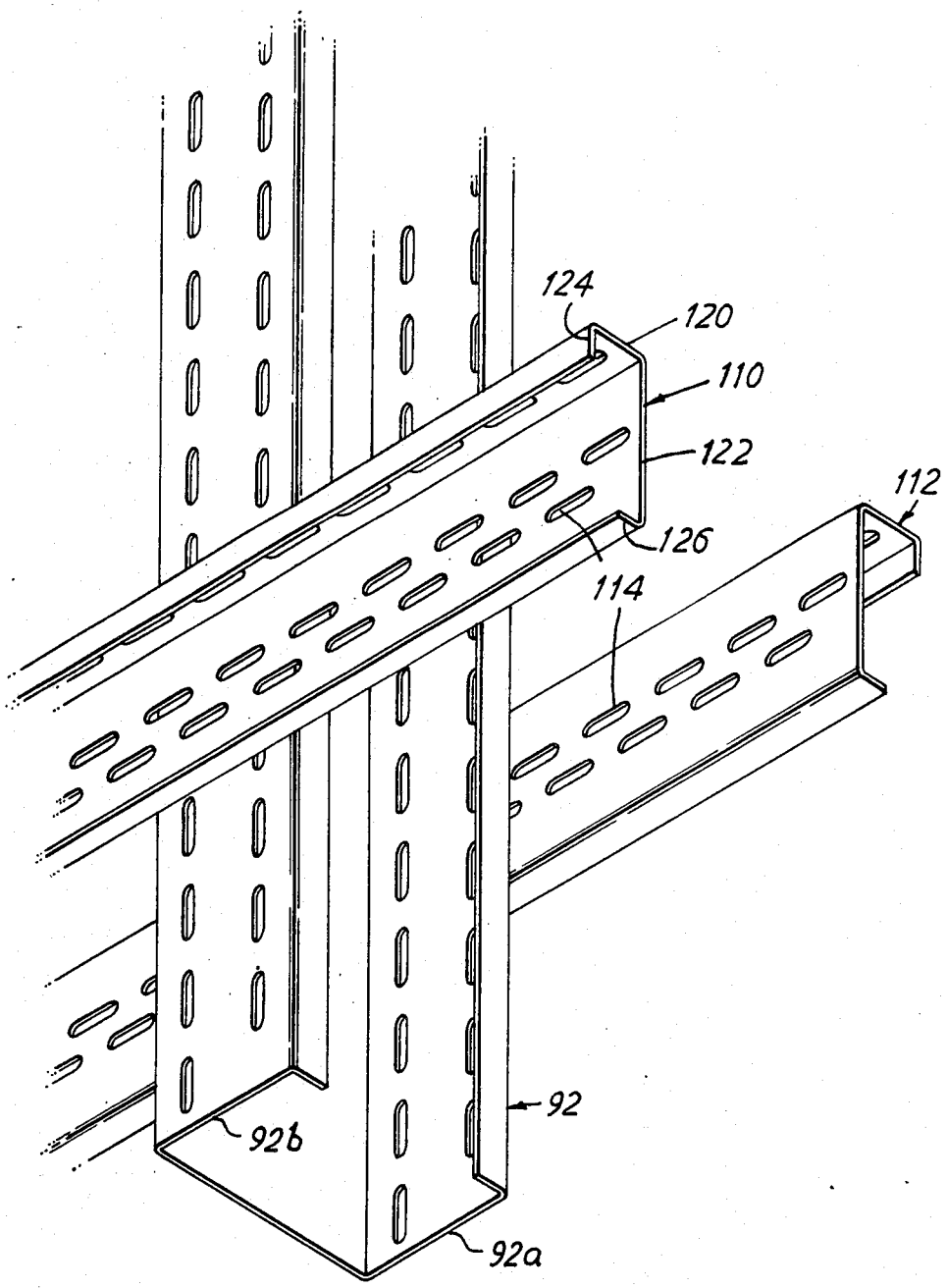

One embodiment of bracket (which can also be termed a butterfly clip) is illustrated in FIGS. 5–7. The bracket has substantially parallel walls 50,52 joined by a bridge piece 54. In the use of such a bracket, a top inner corner of a panel to be supported is positioned between the walls 50 and 52 and is secured therein in any convenient manner. For example holes 58 may be provided, so that bolts, pins, rivets, or other suitable securing devices can be passed through the bracket walls and the panel fixed therebetween. Each of the walls 50 and 52 of the bracket has a notch 60 in its inner edge, to receive a flange of a horizontal rail. As illustrated in FIG. 6, the rail employed may be the rail of FIGS. 1–4 but a rail as shown in FIG. 16 may equally well be employed in association with a matching bracket, i.e. one of appropriate dimensions and with appropriately positioned slots or steps. Each of the walls 50 and 52 has a further notch 64 in its upper edge which is to receive the vertical flange 18 of the rail. As seen in FIGS. 6 and 7, a panel 68 is located with its upper inner corner between the walls 50 and 52. The panel 68 may be a simple rectangular piece of wood, metal or plastics, with an L-shaped part of its top corner removed as indicated by the dotted line 69. In accordance with the principles explained in patent application No. 83-26708, the notches 60,64 are defined by one vertical wall and one sloping or curved wall. The corners 65 (FIG. 5) may be radiused if desired.

FIGS. 8–11 illustrate an alternative form of bracket according to the invention. This has substantially parallel walls 70 and 72 joined by a bridge piece 74. The walls are substantially rectangular as illustrated, one corner of each being cut off as seen best at 79 in FIG. 9. A slot 76 is let into the top edge of each wall 70, 72 near to the inner end, and a slot 78 is let into the bottom edge of wall 70,72 as illustrated. Each slot 76, 78 has one straight surface and one sloping surface. The purpose of these slots can be seen from FIG. 12 which shows how they co-operate with a rail 80. Each wall 70,72 has holes 82 to receive bolts, pins or other suitable securing means whereby a panel 84 is attached to the bracket.

Figure 12:
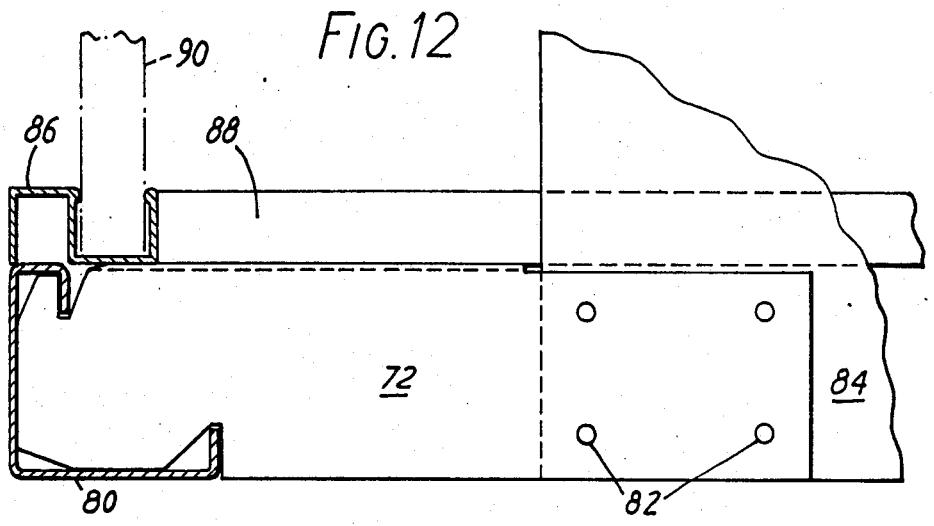
FIG. 12 illustrates the bracket of FIGS. 8–11 in co-operation with a second embodiment of elongate support member, here also called a rail.

FIG. 12 shows part of a cupboard or bookcase assembled using the invention. The cupboard has a floor member 88 which is supported between an adjacent pair of panels 84. The panels may have horizontal grooves to receive the opposed edges of the floor member 88. As seen in FIG. 12, a track 86 for slidably supporting the lower edge of a sliding door 90 is secured to the front edge of the floor member 88.

An alternative form of bracket according to the invention is illustrated in FIGS. 17–20. This form of bracket makes possible the erection of space dividing structures, for example the sub-division of a large space into rooms, offices or cubicles in an extremely simple, convenient and rapid manner. The system described involves the use of vertical telescopic stanchions, which are located at intervals throughout the space to be divided. They can be regarded as linearly-spaced pillars extending between floor and roof. These pillars are joined to and support horizontal rails, the stanchions and the rails being provided with slots so that these members can be readily bolted together. The rails are of the form illustrated at 110 in FIG. 16, or in FIG. 28, and co-operate with brackets (such as an appropriately-dimensioned bracket according to FIGS. 5–7 or one according to FIGS. 24–27) chosen in accordance with the kind of panel to be supported. The panels serve as the walls which divide the space as required.

Reverting now to FIG. 13, one example of stanchion is illustrated. It is formed by a first metal profile 90 sliding within a second metal profile 92. A suitable jack mechanism, cam mechanism, or rack and gear mechanism may be provided to allow the inner profile 90 to be urged upwardly, relatively to the profile 92, towards the ceiling 102 in order to engage the same and clamp the stanchion between floor and ceiling. Such a mechanism is known as per se and so is not described in detail in this specification. Alternatively, the stanchion may be simply bolted between floor and ceiling. A load spreading pad 94 is attached to the top of the profile 90. A like load spreading pad 96 is attached to a further length of inner profile 98, similar to profile 90. As seen in FIG. 14, bolt holes indicated at 100 are provided whereby the outer profile 92 can be bolted to the lower inner profile 98. The ceiling level is indicated at 102. The profile 92 has spaced openings 104 therein (FIG. 14); these are to allow services such as electric cables to be led into and out of the central volume of the stanchion. Provision is made for holes as indicated at 106 (FIG. 15) whereby the load spreading plate 96 may be bolted to the floor, if desired.

FIG. 16 illustrates a stanchion such as is shown in FIGS. 13–15, connected to two horizontal rails 110 and 112. These rails may be bolted to the stanchion and for this purpose elongated slots 114 are provided in each of the webs of the rails 110,112 and in the webs **92*a* and 92*b* of the profile 92**.

Describing the rail 110 for example, this has a horizontal web 120, a vertical web 122, a downwardly extending flange 124, and a horizontally extending flange 126. Unlike the rail shown in FIG. 1, both the flanges 124 and 126 are continuous. The rails 110 and 112 are intended to co-operate with a bracket such as is shown in FIGS. 17–20, the assembled position of the parts being seen in FIG. 21.

Figure 17:
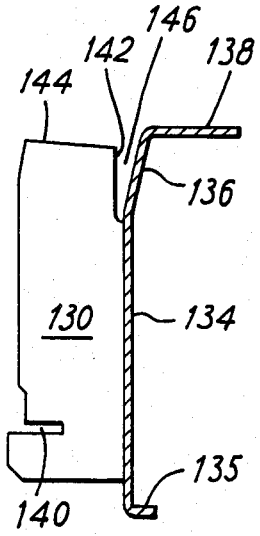
FIGS. 17–20 are respectively vertical medical cross section of, top plan view of, end elevation, and profile of a blank for making a bracket according to another embodiment of the invention, this bracket being intended for fixing a panel parallel to a rail rather than perpendicular to it.
Figure 18:
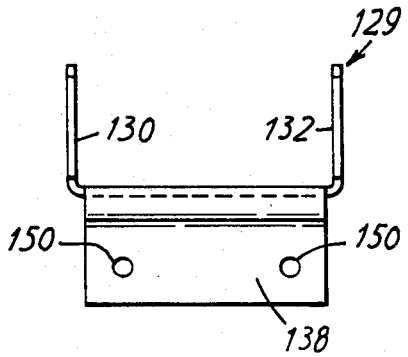
Figure 19:
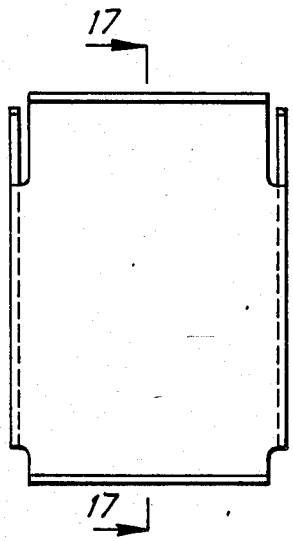
Figure 20:
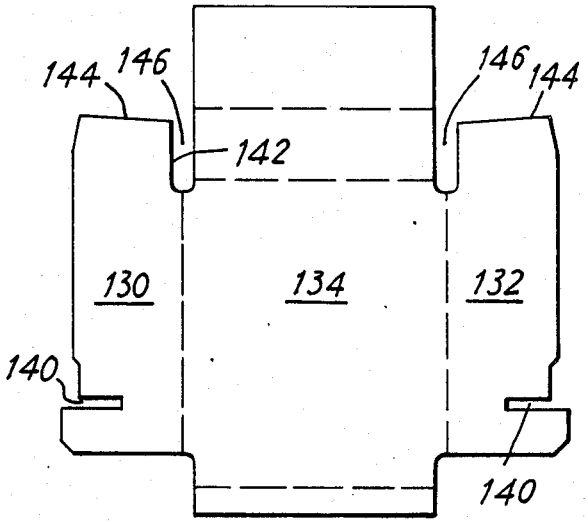

The bracket is shown in FIGS. 17–19. The bracket illustrated in these figures has substantially parallel walls 130,132, connected by a bridge piece 134. The bridge piece 134 has an extension consisting of an upwardly sloping portion 136 and a substantially horizontal portion 138. Each wall 130,132 has a slot 140, and there is a step 142 in the top edge 144 of each wall; this step in conjunction with the edge of the sloping wall portion 136 defines a second slot 146, there being one slot 146 on each side of the bridge portion 134. The purpose of these slots is to receive the downwardly extending flange 124 of the rail 110, and the purpose of slots 140 is to receive the horizontally extending flange 126 of the same rail. It can be understood, therefore, that the bracket according to FIGS. 17–19 can be inserted into and firmly supported by the rail 110 by essentially the same "lift and rotate" procedure as has been described previously in relation to the rail of FIG. 1 and the bracket of FIGS. 5–7.

Suitable holes 150 are indicated in FIG. 18; these are to receive screws or bolts whereby a panel can be suspended with its plane parallel to the length of the rail 110 or 112 as the case may be.

Figure 21:
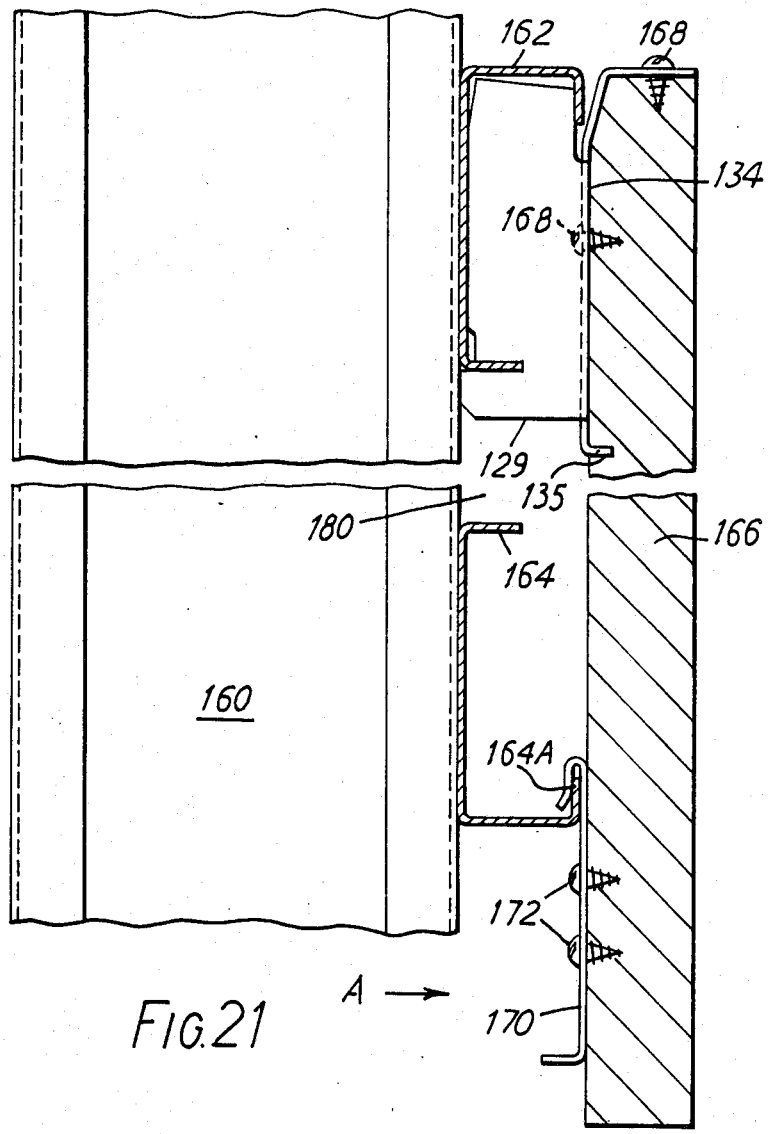
FIG. 21 is a vertical cross section illustrating use of the bracket of FIGS. 17–20 and also showing a stanchion and a bottom clip used to hold a lower region of a panel to a lower rail.

Details of this suspension are best seen from FIG. 21. Referring now to FIG. 21, a stanchion 160 which may be a stanchion according to FIG. 13 supports horizontal rails 162,164. These rails are of the construction of rails 110,112 in FIG. 16. The upper rail 162 supports a bracket 129, which is preferably of the kind shown in FIGS. 17–19 and this bracket in turn supports a panel 166. As shown, screws 168 extending through the holes 150 and other holes in the wall 134 hold the panel 166 to the bracket 129. To assist in bearing the weight, a slot is cut in the rear wall of the panel to receive the flange 135 of the bracket 129.

Figure 22:
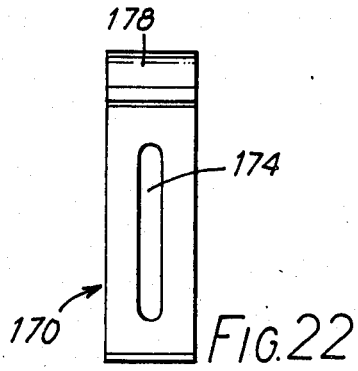
FIGS. 22 and 23 show a clip which can be used to secure a lower region of a panel to a rail.
Figure 23:
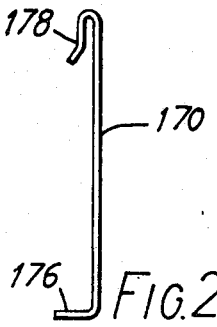
Figure 24:
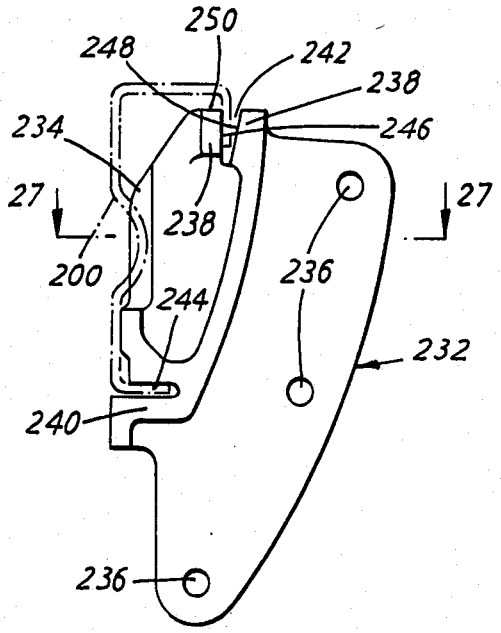
FIGS. 24–27 show a further version of a bracket according to the invention.
Figure 26:
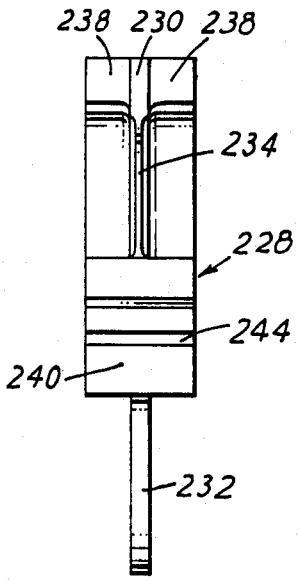
Figure 25:
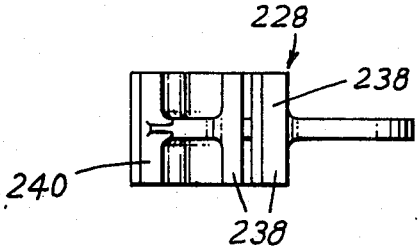
Figure 27:
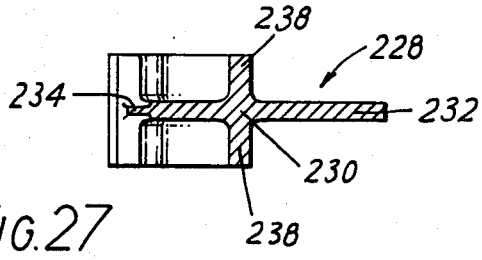

In some circumstances it may be desirable to retain the lower region of the panel against outward movement. For this purpose, a clip 170 is provided, fixed to the panel 166 by screws 172. The clip 170 is illustrated in FIGS. 22 and 23, FIG. 22 being a view looking in the direction of the arrow A in FIG. 21, and FIG. 23 being an end or edge view. The illustrated clip 170 is preferably a flat plate of metal having a central slot 174, a lower flange 176, and a turned over portion 178 which as seen, clips over an upstanding flange **164*a* of the rail 164 (FIG. 21). The screws 172 pass through the slot 174**, and during installation are initially only partially tightened in order to allow the clip to slide vertically.

Using the system and parts illustrated in FIGS. 13–23, a space can readily be divided as desired. An advantage of the system is that supply services such as electrical cables can readily be housed in the space 180 behind the panels 166, and moreover the central volume of the stanchion 90, 92 or 160 and, optionally, the space 180, can be filled with fire resistant and/or sound insulating and/or heat insulating material. The method of erection of the system, as can be seen from the preceeding description, is simple and foolproof and is well within the capacity of unskilled workers. The system is versatile and utilises only a relatively small number of parts, all of which can be inexpensively manufactured.

Figure 28:
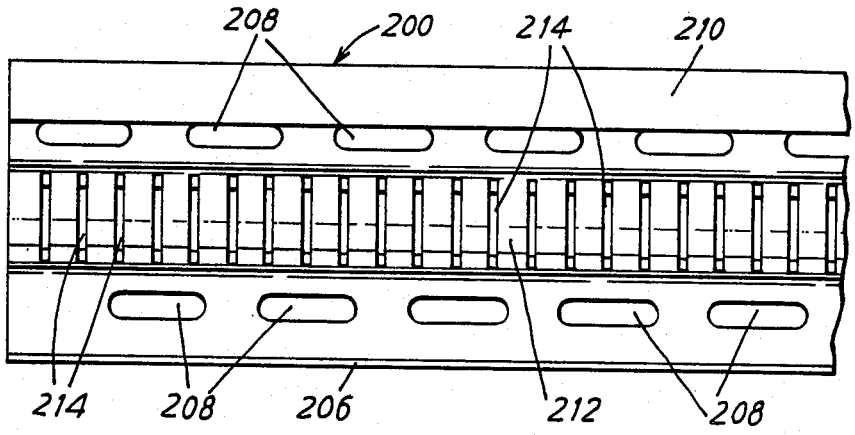
FIGS. 28 and 29 are a front view and an end view of an elongate support member (also herein called a rail) specially designed for use with the bracket of FIGS. 24–27.
Figure 29:
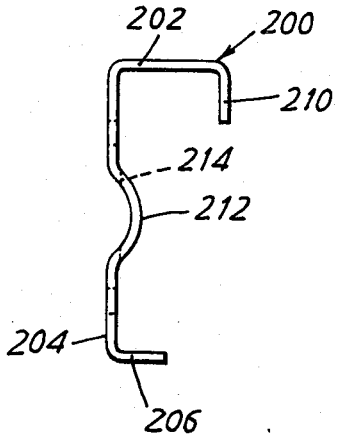

FIGS. 24–29 illustrate an alternative rail and a bracket for use therewith, in accordance with the invention. The rail 200 shown in FIGS. 28 and 29 is an elongate support member having a horizontal web 202 and a web 204 to engage a wall or other support. A continuous horizontal flange 206 extends outwardly from the web 204, and the web 202 has a downwardly depending flange 210. The web 204 has a curved or bulged portion 212, bulging outwardly away from the wall or support surface in the mounted position of the rail, and this bulged portion has a series of substantially vertical through slots 214 at regular intervals. The purpose of these is to locate the brackets (228) along the length of the rail 200, for which purpose a blade portion (234) of the brackets extends into one of the slots 214. The web 204 has holes 208 therein whereby it may be screwed, bolted, riveted or otherwise secured to a generally vertical surface of a support such as a wall, or to a stanchion such as that illustrated in FIG. 13.

The bracket 228 illustrated in FIGS. 24–27 may be made as a metal die-casting. It has a main body portion 230 from which extends a first blade portion 232 and a second blade portion 234, the latter being intended to co-operate with (extend into) one of the slots 214 to locate the bracket. The blade portion 232 is for attachment of a panel to the bracket. In the case of a wooden panel, a saw cut maybe provided in one corner of the panel, parallel to the planes of the panel surfaces, and the blade portion 232 is inserted in the saw cut. Then bolts or screws are passed through previously-provided holes in the panel which register with holes 236 in the blade portion 232, so attaching the panel (not shown) to the bracket 228. This may be done either before or after the bracket 228 is engaged with the rail 200 but in some practical applications, especially where ceiling headroom is limited, it may be preferable, or even necessary, to engage the bracket 228 with the rail 200 using the "lift and rotate" procedure described herein, prior to attaching the panel to the bracket. The body portion 230 has laterally extending upward and outward webs 238 and 240, respectively, into which respective notches 242 and 244 (FIG. 24) extend. The upper notch 242 is defined by a sloping wall 248 and a substantially vertical wall 246, the former wall being sloped so as to facilitate employment of the "lift and rotate" method of engaging the bracket 228 with the rail 200. The walls of the lower notch 244 are substantially parallel. The overall height of the bracket 228, measured from its top surface 250 to the upper wall defining the notch 244 is slightly less than (e.g. 2% to 4% less than) the height of the rail measured from the lower surface of web 202 to the upper surface of the flange 206. This, in conjunction with the shape of the notch 242, enables the "lift and rotate" procedure of engaging the bracket 228 with the rail 200 to be employed without sticking or binding between the parts.

I claim:

1. A bracket for suspending a panel from an elongated linear support member having vertical and horizontal flanges, the bracket comprising a first blade portion and a main body portion, said main body portion having first and second body webs extending laterally to the blade portion, said first and second body webs each having walls defining respective first and second notches into which respective flanges of the support member can extend, said first body web presenting a substantially flat surface in an upward direction and the first notch being defined by a vertical wall and an inclined wall, said second body web presenting a flat surface in a direction substantially perpendicular to said first body web and said second notch being defined by a pair of walls of which at least one is substantially horizontal.

2. The bracket according to claim 1 further comprising a second blade portion which extends away from the said first blade portion.

3. The bracket according to claim 1 wherein the said first blade portion further includes holes therethrough for the attachment of a panel to the bracket.

4. An apparatus for supporting or erecting structures comprising a bracket which engages an elongated linear support, said elongated linear support member having a vertical support member web and a horizontal support member web, said horizontal support member web having a vertical, downwardly extending flange and said vertical support member web having a horizontal extending flange, said bracket having a first blade portion and a main body portion, said main body portion having first and second body webs extending laterally of said first blade portion, said first and second body webs each having walls defining respective first and second notches, said first body web presenting a substantially flat surface in an upward direction and said first notch being defined by a vertical wall and an inclined wall, such that said vertical, downwardly extending flange extends into said first notch when said bracket engages said elongated linear support, said second body web presenting a substantially flat surface in an outward direction and said second notch being defined by a pair of walls of which at least one is substantially horizontal, such that said horizontally extending flange extends into said second notch when said bracket engages said elongated linear support.

5. The apparatus according to claim 4 wherein said vertical web of said elongated linear support member has a series of spaced parallel slots therethrough and said bracket has a second blade portion to engage one of said slots in order to position the bracket longitudinally relative to said elongated linear support member.

6. The apparatus according to claim 4 wherein said first blade portion has holes therethough for the attachment of a panel to the bracket.

* * * * *